US008944675B2

(12) United States Patent
Mallet et al.

(10) Patent No.: US 8,944,675 B2
(45) Date of Patent: Feb. 3, 2015

(54) BALANCE WITH INERTIA ADJUSTMENT USING AN INSERT

(75) Inventors: Daniel Mallet, Le Luhier (FR); Frederic Tolle, Le Locle (FR); Philippe Barthoulot, Maiche (FR); Daniel Vicente, Colombier (CH); Emmanuel Graf, Le Locle (CH); Philomene Berger, Provence (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 48 days.

(21) Appl. No.: 13/809,032

(22) PCT Filed: Jul. 5, 2011

(86) PCT No.: PCT/EP2011/061294

§ 371 (c)(1),
(2), (4) Date: Mar. 22, 2013

(87) PCT Pub. No.: WO2012/010410

PCT Pub. Date: Jan. 26, 2012

(65) Prior Publication Data

US 2013/0188461 A1 Jul. 25, 2013

(30) Foreign Application Priority Data

Jul. 19, 2010 (EP) ..... 10170005

(51) Int. Cl.

| | |
|---|---|
| ***G04B 17/06*** | (2006.01) |
| ***G04B 17/20*** | (2006.01) |
| ***G04B 17/22*** | (2006.01) |
| ***G04B 18/00*** | (2006.01) |

(52) U.S. Cl.

CPC ..... *G04B 17/20* (2013.01); *G04B 17/222* (2013.01); *G04B 17/063* (2013.01); *G04B 18/006* (2013.01)

USPC ..... 368/171

(58) Field of Classification Search

CPC ... G04B 17/063; G04B 17/222; G04B 18/006
USPC ..... 368/169–174
See application file for complete search history.

(56) References Cited

U.S. PATENT DOCUMENTS

| | | | | |
|---|---|---|---|---|
| 3,161,012 | A * | 12/1964 | Hug et al. | 368/169 |
| 6,354,731 | B1 * | 3/2002 | Halter | 368/148 |
| 6,666,575 | B2 * | 12/2003 | Scheufele | 368/127 |

(Continued)

FOREIGN PATENT DOCUMENTS

| | | |
|---|---|---|
| CH | 343 904 | 12/1959 |
| CH | 345 600 | 3/1960 |
| WO | 2008 080570 | 7/2008 |

OTHER PUBLICATIONS

International Search Report Issued Sep. 29, 2011 in PCT/EP11/61294 Filed Jul. 5, 2011.

*Primary Examiner* — Vit W Miska
(74) *Attorney, Agent, or Firm* — Oblon, Spivak, McClelland, Maier & Neustadt, L.L.P.

(57) ABSTRACT

A balance set for a timepiece, with inertia adjustment for adjusting inertia and/or balancing and/or oscillation frequency of the balance, with a balance including an insert inserted into a recess of a felloe connected to a hub by a joining surface. The balance includes on the felloe thereof an elastic holding mechanism including two antagonistic elastic lips which, when stressed, allow insertion of the insert into the recess and which, when released, prevent removal of the insert from the recess. A sprung balance or a timepiece can incorporate such a balance.

17 Claims, 3 Drawing Sheets

(56) References Cited

U.S. PATENT DOCUMENTS 8,636,403 B2 * 1/2014 Maier et al. ..... 368/169
8,662,742 B2 * 3/2014 Damasko ..... 368/171
2006/0153007 A1 * 7/2006 Chester ..... 368/12
2007/0140065 A1 * 6/2007 Levingston ..... 368/127
2010/0054090 A1 3/2010 Orny et al.

* cited by examiner

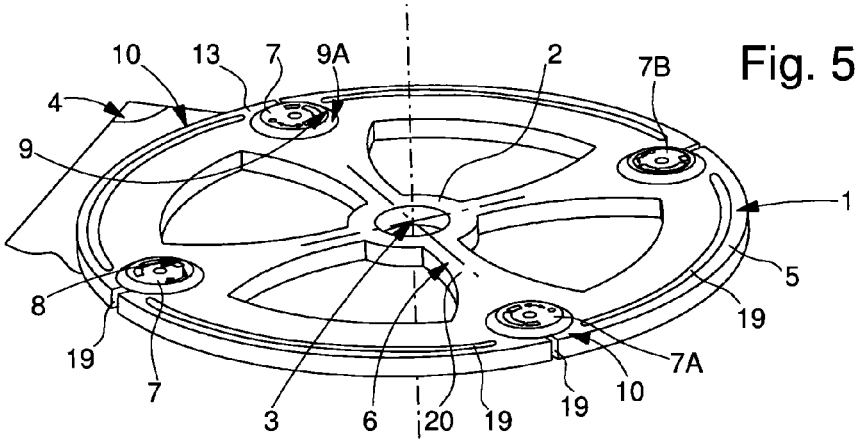
Fig. 5
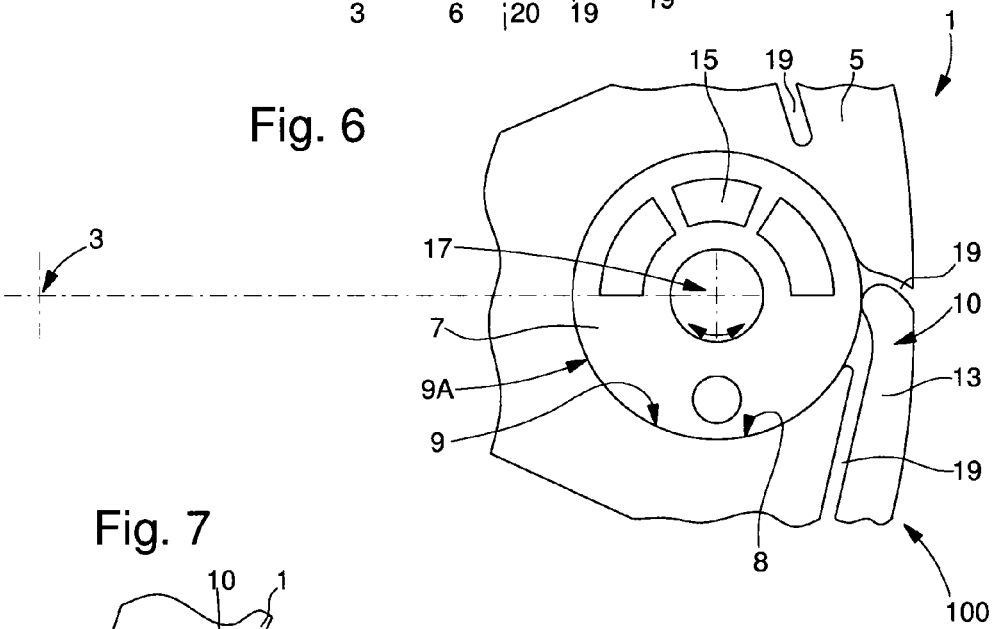
Fig. 6
Fig. 7
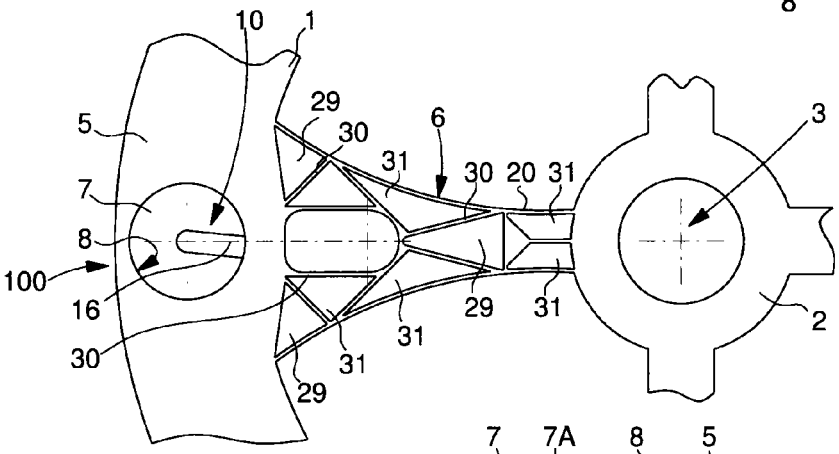
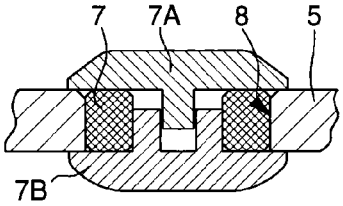
Fig. 8

BALANCE WITH INERTIA ADJUSTMENT USING AN INSERT

FIELD OF THE INVENTION

The invention concerns a method of making a balance set for a timepiece, with inertia adjustment for adjusting the inertia and/or poising and/or oscillation frequency of the balance, comprising, on the one hand, a balance including a hub arranged to cooperate with a balance staff perpendicular to a balance plane, and a peripheral, continuous or discontinuous felloe, connected to said hub by at least one joining surface, said balance set comprising, on the other hand, at least one insert. Said balance further comprises, at the periphery of said felloe, at least one recess for receiving said at least one insert, said insert comprising a complementary guide means, whose profile is complementary to a guide means comprised in said recess.

The invention further concerns a balance for a timepiece, with inertia adjustment for adjusting the inertia and/or poising and/or oscillation frequency of the balance, designed for a balance set of this type, and including a hub arranged to cooperate with a balance staff perpendicular to a balance plane, and a peripheral, continuous or discontinuous felloe, connected to said hub by at least one joining surface. Said balance set comprises, at the periphery of said felloe, at least one recess for receiving at least one insert, said insert comprising a complementary guide means whose profile is complementary to a guide means comprised in said recess.

The invention further concerns a balance set for a timepiece, with inertia adjustment for adjusting the inertia and/or poising and/or oscillation frequency of the balance, assembled according to said method and comprising a balance, which in turn includes a hub, arranged to cooperate with a balance staff perpendicular to a balance plane, and a peripheral, continuous or discontinuous felloe, connected to said hub by at least one joining surface. Said balance comprises, at the periphery of said felloe, at least one recess for receiving at least one insert, said insert comprising a complementary guide means whose profile is complementary to a guide means comprised in said recess.

The invention also concerns a sprung balance incorporating a balance of this type.

The invention also concerns a timepiece incorporating this type of sprung balance or balance.

The invention concerns the field of regulating members for timepieces and more specifically the balance or sprung balance.

BACKGROUND OF THE INVENTION

The precision of a calibre depends upon the quality of its regulating member, and very high oscillation frequencies, for example of 10 Hz, compared to the usual frequencies of 2.5 to 4 Hz, are only obtainable if suitable regulating members are devised, in particular as regards the balance.

Indeed, the energy to be provided for maintaining oscillation, in the form of elastic balance spring torque, is proportional to the product, on the one hand, of the inertia of the balance about the pivoting axis, and, on the other hand, of the square of the frequency. Thus, for example, for the same energy, a frequency change from 4 Hz to 10 Hz results in the inertia being divided by approximately 6. For a frequency of 4 Hz, a balance inertia of 12 mg/cm$^2$ is considered to be good, since this type of balance conventionally has a diameter of 9 to 10 mm. Thus, a balance for use at 10 Hz must have a low inertia value, in particular less than 2 mg/cm$^2$.

For optimum operation, a balance for use at 10 Hz must also have minimal mass, notably less than 30 mg, so as to reduce friction in the bearings, to avoid isochronism disturbance in the various positions of use.

Although it has low mass and inertia, the balance of a high frequency oscillator must also allow adjustment of the unbalance and perfect poising, both static and dynamic, and the construction thereof must make setting and/or adjustment operations possible. It is not therefore possible to use conventional technology, or solutions with lighter balances such as the balances wherein the felloe has spokes (?) disclosed in FR Patent No. 1275 357 in the name of Straumann, or FR Patent No. 1 301 938 in the name of LIP. Indeed, even the reduced mass of these balances does not provide sufficiently low inertia. Likewise, the mass and inertia of a titanium balance in accordance with EP Patent No. 1 562 087, in the name of MONTRES BREGUET SA and devised with a titanium felloe and arms and reduced sections, are still greater than required for optimum operation.

A Q factor on the order of 500 is also sought, thus considerably higher than that of conventional oscillators where, for good quality watches, the Q factor is close to 220 to 280. This Q factor can only be obtained by combining a silicon or similar balance spring with a balance that satisfies the above conditions. In addition to obtaining a high Q factor, combined with setting and adjustment possibilities, the index-assembly must also be omitted.

Moreover, since the mass of the unit is limited, the smallest possible number of components should be preferred.

However, micro-machinable materials, such as silicon and quartz, which are theoretically made in finite dimensions, with very precise tolerances, in their development method, are not easy to machine subsequently.

Various documents describing improvements made to balances are known. CH Patent Application No. 343,904A, in the name of ROLEX MONTRES, discloses a balance felloe comprising an elastic holding means, in the form of a slot, locking an insert formed by an inertia-block pin. WO Patent Application No. 2008/080570 A2, in the name of COMPLITIME SA, discloses inertia-blocks provided with slots for a friction fit. EP Patent Application No. 1,351,103 A1, in the name of CHOPARD MANUFACTURE SA, discloses elastic U-shaped inertia-blocks inserted into recesses in the felloe via elastic deformation. CH Patent Application No. 345,600 A, in the name of ROLEX WATCHES, discloses a slit sleeve for holding and elastically gripping an inertia-block. CH Patent Application No. 261,431 A, in the name of PATEK PHILIPPE, discloses adjustment weights centred on studs and immobilised by their own elasticity. CH Patent Application No. 89,273 A, in the name of PAUL DITISHEIM, discloses non-protruding filler weights held by their own elasticity on walls of a cavity which may or may not be threaded. CH Patent Application No. 280,067 A, in the name of PATEK PHILIPPE, presents adjustment weights elastically mounted on a stud, whose centre of gravity is off-centre relative to said stud.

It is therefore necessary, for regulating members made of such materials or incorporating at least one component made of this type of material, to have the possibility of frequency and/or inertia adjustments, but by avoiding machining and by prioritising setting possibilities.

SUMMARY OF THE INVENTION

The inventive step consists in creating the conditions for a balance structure, including the hub, felloe, and connections between these two components, which is as light as possible, moving as far as possible from the hub any masses of density higher than said structure, and incorporating in said structure regulating means for performing settings and adjustments without reverting to machining.

The invention therefore concerns a timepiece balance, with inertia adjustment for adjusting the inertia and/or poising and/or oscillation frequency of the balance, comprising a hub arranged to cooperate with an arbour pivoting about a balance staff perpendicular to a balance plane, and a peripheral, continuous or discontinuous felloe, connected to said hub by at least one joining surface. Said balance comprises, at the periphery of said felloe, at least one recess for receiving at least one insert, said insert being of the type comprising a complementary guide means with a complementary profile to the guide means comprised in said recess, and said recess includes an elastic holding means for holding said insert inside said recess after the insertion of said insert therein, said elastic means including at least two elastic lips, extending on both sides of said insert so as to exert stresses or torques in opposite directions on said insert.

According to a feature of the invention, said elastic holding means is made in said felloe of said balance and arranged to hold said insert inside said recess in a radial direction relative to said balance staff for a radial adjustment of said insert.

According to a feature of the invention, said elastic holding means is made in said felloe of said balance and arranged to hold said insert inside said recess in a radial direction relative to said balance staff, said elastic holding means further forming an active thrust means by forming a bearing surface which tends to push said insert against at least one fixed or elastic stop member provided in said recess.

According to a feature of the invention, said elastic holding means is made in said felloe of said balance and arranged to hold said insert inside said recess in a tangential direction relative to said felloe.

According to a feature of the invention, said elastic holding means is made in said felloe of said balance and arranged to hold said insert inside said recess both in a radial direction relative to said balance staff and in a tangential direction relative to said felloe.

According to a feature of the invention, said elastic holding means includes a first elastic holding means and a second elastic holding means, said first elastic holding means, respectively said second elastic holding means, performing the function of a retaining click when said second elastic holding means, respectively said first elastic holding means, pivots said insert.

According to a feature of the invention, said felloe is made in a single piece with said joining surface and said hub in micro-machinable material, or silicon, or quartz or a compound thereof, or an alloy derived from MEMS technology, or an alloy of the type obtained via the "LIGA" method.

The invention further concerns a balance set for a timepiece, with inertia adjustment for adjusting the inertia and/or poising and/or oscillation frequency of the balance, comprising, on the one hand a balance including at least one recess with a guide means, and on the other hand, at least one insert comprising a complementary guide means having a complementary profile to said guide means, said balance and/or said insert comprising an elastic holding means arranged, in a first position of insertion where said elastic holding means is stressed, to allow the insertion of said insert into said recess, and in a second, holding position where said elastic holding means is released, to prevent the removal of said insert from said recess, said insert being able to be inserted into a said recess by the stressing of said elastic holding means into said first position of insertion, said elastic holding means being able to be released into said second, holding position after the complete insertion of each said insert into said recess thereof to hold said insert inside said recess. Said balance is made according to any of the preceding variants(?) and comprises said elastic means comprising at least two elastic lips, extending on both sides of said insert so as to exert stresses or torques in opposite directions on said insert.

According to a feature of the invention, said insert comprises an elastic holding means arranged, in a first, insertion position where said elastic holding means is stressed, to allow the insertion of said insert into said recess and, in a second, holding position in which said elastic holding means is released, to prevent the removal of said insert from said recess.

According to a feature of the invention, said insert is rigid.

According to a feature of the invention, said insert is gripped and enclosed between at least two flanges, arranged to rest on both sides of said felloe and to be assembled to each other by a means of permanent assembly, so that the sub-assembly formed by the assembly of said two flanges has a maximum of one degree of freedom to pivot or move in translation relative to said felloe.

According to a feature of the invention, said insert is arranged to have, after the insertion thereof into said balance, at least one visible surface made of a material capable of being micro-machined or undergoing laser material removal.

According to a feature of the invention, said guide means and said complementary guide means are arranged, in said second, holding position, to allow said insert mobility in translation or by pivoting inside said recess.

According to a feature of the invention, said elastic holding means is arranged to hold said insert inside said recess in an angular pivoting position relative to a pivot axis of said insert in said recess.

According to a feature of the invention, said elastic holding means includes a first elastic holding means and a second elastic holding means both formed by elastic lips, and said complementary guide means of said insert is made in the form of a toothing at the periphery of said insert, which cooperates with the ends of said elastic lips, whose directions are secant to each other.

According to a feature of the invention, said first elastic holding means, respectively said second elastic holding means, acts as a retaining click when said second elastic holding means, respectively said first elastic holding means pivots said insert, so as to perform a double ratchet setting adjustment in both pivoting directions about a pivot axis of said insert.

According to a feature of the invention, said elastic holding means is arranged, under the effect of a stress that tends to move said means away from said second, holding position, to pivot said insert inside said recess relative to a pivot axis of said insert in said recess.

According to a feature of the invention, said insert is formed by an adjusting screw, or respectively a splined shaft, which can move between sections of threaded paths, respectively notches or grooves, which are located opposite each other and carried by two antagonistic elastic lips, and which are arranged to lock said insert after adjustment.

The invention also concerns a sprung balance incorporating at least one such balance set (?) or at least one such balance whose felloe is in a single piece with said joining surface and said hub in a micro-machinable material, or silicon, or quartz, or a compound thereof, or an alloy derived from MEMS technology, or an alloy obtained from the "LIGA" process.

The invention further concerns a timepiece incorporating at least one sprung balance of this type or at least one balance of this type or at least one balance set of this type, whose felloe is in a single piece with said joining surface and said hub in a micro-machinable material, or silicon, or quartz, or a compound thereof, or an alloy derived from MEMS technology, or an alloy obtained from the "LIGA" process.

The invention further concerns a sprung balance incorporating at least one such balance.

The invention also concerns a timepiece incorporating at least one such sprung balance or at least one such balance.

With the preferred use of silicon a balance structure is obtained which is both very light and very rigid, and which may be honeycombed in the area of the joint between the hub and the felloe. Transferring inserts, which may be provided with screws, to the periphery contributes to obtaining properly dimensioned inertia despite the very low total mass of the balance. The adjustment and poising functions are guaranteed and facilitated.

This type of balance is perfectly suitable for good operation at a frequency of 10 Hz and at frequencies higher than 10 Hz.

BRIEF DESCRIPTION OF THE DRAWINGS

Other features and advantages of the invention will appear upon reading the following description, with reference to the annexed Figures, in which:

FIG. 5 shows a schematic, perspective view of a fifth variant of the invention.

FIG. 6 shows, in a similar manner to FIG. 1, a detail of the fifth embodiment of FIG. 5.

FIG. 7 shows a schematic, partial, front view of a detail of a particular balance structure.

FIG. 8 shows a schematic, partial cross-section, passing through the balance staff, of a detail of the fifth variant of FIG. 5.

DETAILED DESCRIPTION OF PREFERRED EMBODIMENTS

Figure 1:
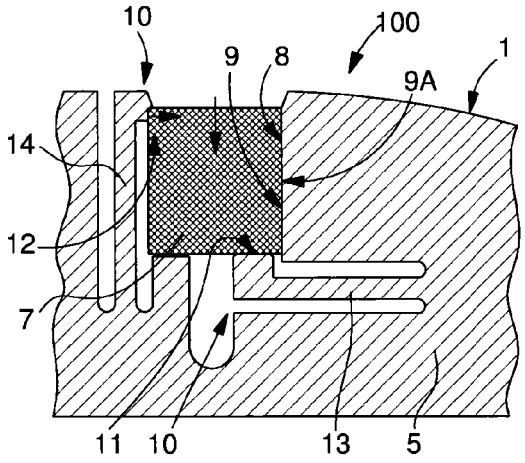
FIG. 1 shows a schematic, partial, cross-section, perpendicular to the balance staff, of a detail at the periphery of the felloe of a first balance set variant made according to the invention.

The invention concerns the field of regulating members for timepieces and more specifically the balance or sprung balance.

The invention is more specifically directed towards the production of balances for high oscillation frequencies, of 10 Hz or higher.

Five variant embodiments, which are in no way limiting, are shown in the Figures.

The invention concerns the making of a timepiece balance set 100 with inertia adjustment for adjusting the inertia and/or poising and/or oscillation frequency of the balance.

The timepiece balance set 100 includes a timepiece balance 1 with inertia adjustment for adjusting the inertia and/or poising and/or oscillation frequency of the balance. This balance 1 includes a hub 2 arranged for cooperating with an arbour pivoting about a balance staff 3 perpendicular to a balance plane 4 and a peripheral, continuous or discontinuous felloe 5. This felloe 5 may in fact be discontinuous for the purpose of making the balance lighter. A continuous felloe 5, as shown in FIG. 5, offers the advantage of good rigidity and good aero-dynamism, and limits any local bending by preventing balance 1 from warping.

This felloe 5 is connected to hub 2 by at least one joining surface 6, which may be formed of a continuous surface such as a pierced or non-pierced disc, or by several arms 20. Making a pierced joining surface 6, notably with cut out portions, which may or may not be through cuts, between lateral members providing good triangulation, further reduces the mass of the balance.

Preferably, in all the variants of all the embodiments described below, to obtain a balance with high level performance, at an oscillation frequency of 10 Hz or more, felloe 5 will be made in a single piece with joining surface 6 and hub 2 in a micro-machinable material, or silicon, or quartz, or a compound thereof, or an alloy derived from MEMS technology, or an alloy such as that obtained by the "LIGA" method, particularly, but not restrictively, a nickel or aluminium based alloy obtained by the "LIGA" method. The selection of silicon gives particularly good results and is the preferred solution.

This balance set 100 further includes at least one recess 8, located at the periphery of felloe 5 for receiving at least one insert 7.

This balance set 100 further includes at least one insert 7. This insert 7 is added onto or into felloe 5 in a recess 8 of this type. This recess 8 comprises a guide means 9. Insert 7 includes a complementary guide means 9A whose profile is complementary to guide means 9.

Preferably, insert 7 or each of the parts forming said insert, is made of a material that is denser than a first material forming felloe 5.

According to the invention:

balance 1 and/or insert 7 is provided with an elastic holding means 10 which is arranged, in a first, insertion position where the elastic holding means 10 is stressed, to allow the insertion of said insert 7 into recess 8, and, in a second, holding position where elastic holding means 10 is released, to prevent the removal of insert 7 from said recess 8. Preferably, at least recess 8 of balance 1 includes this type of elastic holding means 10 for holding an insert 7 in recess 8 after the insertion of said insert therein. Preferably, this elastic means 10 includes at least one elastic lip as seen in FIG. 2. Also preferably, this elastic means 10 includes two elastic lips 13, 14 extending on both sides of said insert 7 so as to exert on said insert 7 stresses or torques in opposite directions, as seen in FIGS. 1, 3 and 12 to 14.

Each insert 7 is inserted into a recess 8 by stressing elastic holding means 10 into the first, insertion position.

Elastic holding means 10 is released into the second, holding position after the complete insertion of each insert 7 into its recess 8.

This elastic holding means 10 is thus arranged to allow the insertion of said insert 7 into its recess 8 and to prevent the removal thereof, as seen in the Figures. Means 10 is preferably formed by clip means and complementary clip means which are preferably irreversibly assembled.

Preferably, guide means 9 and complementary guide means 9A are arranged, in the second, holding position, to allow said insert 7 mobility in translation and/or by pivoting inside recess 8.

Figure 2:
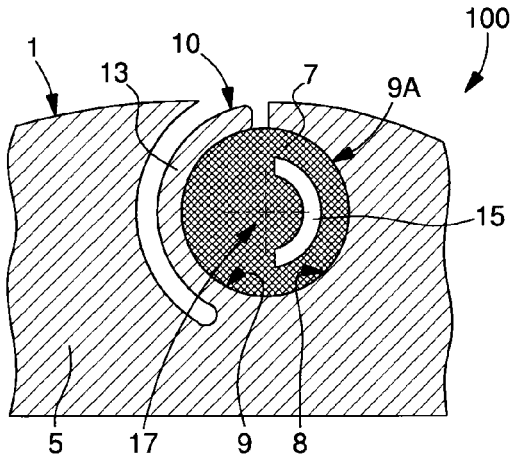
FIG. 2 shows, in a similar manner to FIG. 1, a second variant of the invention.
Figure 11:
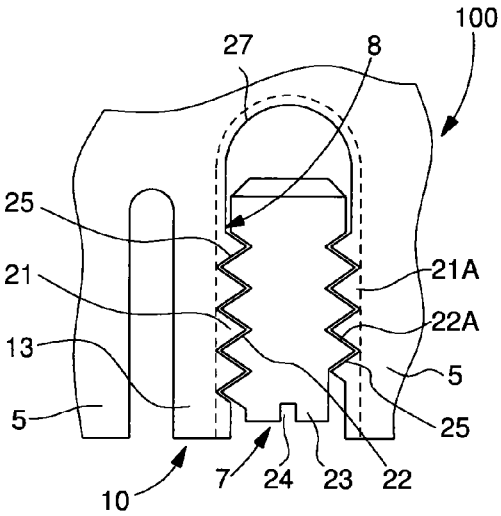
FIG. 11 shows a schematic, partial, front view of a balance set according to the sixth variant.

Mobility with one degree of freedom in translation is illustrated in FIGS. 1 and 11.

Mobility with one degree of freedom to pivot is illustrated in FIGS. 2 to 7. In this case, preferably, but not restrictively, guide means 9 and complementary guide means 9A are substantially cylindrical, or are cylindrical.

As a result of the invention, therefore, there is formed a balance set 100, which is capable of oscillating at a high frequency, notably higher than or equal to 10 Hz, and of allowing fine setting or adjustment operations. This balance set 100 may have different architectures, depending upon whether it is chosen to make elastic holding means 10:

on balance 1;

on the insert or inserts 7;

both on balance 1 on the one hand, and on insert(s) 7 on the other hand.

In a particular embodiment, insert 7 is chosen to be rigid, and elastic holding means 10 is made in felloe 5 of balance 1.

In a first embodiment, elastic holding means 10 is located on balance 1. Insert 7 may then either be rigid or elastic.

In an advantageous embodiment, at least one of recesses 8 comprised in balance 1 includes elastic holding means 10 for holding this insert 7 in recess 8 after the insertion of said insert therein. Preferably, several of these recesses 8, and preferably even all of them, comprise this elastic holding means 10, which may be arranged in different variants which will be described below. The properties of silicon, when balance 1 is made of this material, are particularly suited to forming elastic holding means 10 incorporated in the body of balance 1.

In a second embodiment, the elastic holding means 10 is located on insert 7.

Figure 4:
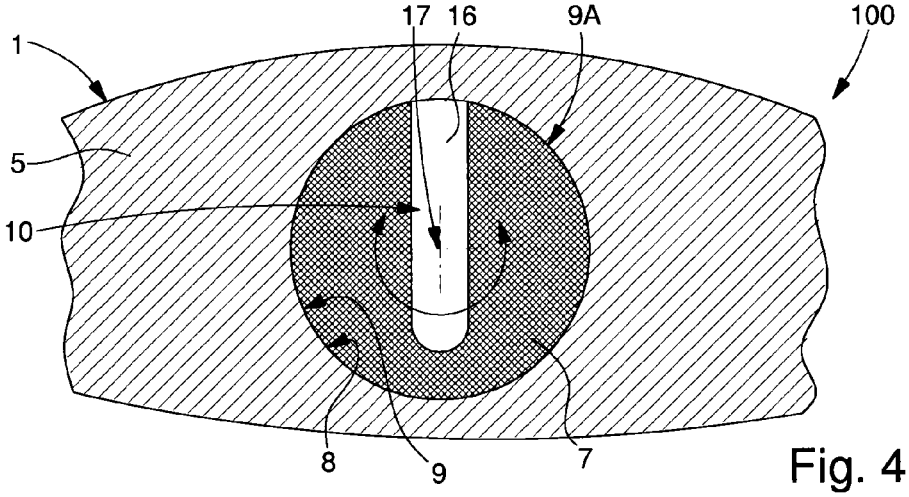
FIG. 4 shows, in a similar manner to FIG. 1, a fourth variant of the invention.

Elastic holding means 10 is then made on the insert or inserts 7, balance set 100 then includes a balance 1, which differs from that of the first embodiment in that it includes, at the periphery of felloe 5, at least one recess 8 for receiving at least one insert 7, and in that recess 8 does not necessarily include elastic holding means. Indeed, in this second embodiment, it is insert 7 which includes elastic holding means 10 for holding said insert in recess 8 after its insertion therein, as seen in FIG. 4, or in FIG. 7, where insert 7 includes a slot 16 which gives it sufficient flexibility. This insert 7 thus forms a slit inertia-block having an unbalance, due to slot 16, and this configuration means that one part can be fitted to the other, without forcing balance 1 beyond breaking point, especially when said balance is made of silicon or similar. This slot 16 is also advantageously used for receiving the end of a tool for adjusting the pivoting thereof relative to its pivot axis 17 in recess 8.

In a third embodiment which is not shown in the Figures, the elastic holding means 10 is made both on balance 1 and on insert(s) 7. Insert 7 then includes this type of holding means 10 and recess 8 also includes elastic holding means 10 for holding insert 7 in recess 8 after its insertion therein.

In the three embodiments, recesses 8, inserts 7 and elastic holding means 10 may take different configurations, including certain preferred and non-limiting configurations which are explained below.

Preferably, elastic holding means 10 is made in felloe 5 of balance 1.

In a first radial configuration, illustrated by the first variant of FIG. 1 or by the sixth variant of FIG. 11, elastic holding means 10 is arranged, preferably made in felloe 5, to hold insert 7 in recess 8 in a radial direction relative to balance staff 3, particularly for a radial adjustment of insert 7.

Preferably, as seen in FIG. 1, insert 7 is held in this radial direction, elastic holding means 10 also forming an active thrust means forming a bearing surface 11 which tends to push insert 7 against at least one fixed or elastic stop member 12 provided in recess 8.

In a second, tangential configuration, illustrated by the second, third, fourth and fifth variants of FIGS. 2 to 7, elastic holding means 10 is arranged to insert and/or hold insert 7 in recess 8 in a tangential direction relative to felloe 5.

In yet another configuration, elastic holding means 10 is arranged to hold insert 7 in recess 8 both in a radial direction relative to balance staff 3 and in a tangential direction relative to felloe 5.

In the first variant of FIG. 1, insert 7 is slid radially through the external diameter of felloe 5 for insertion into balance 1, and it is held in place in recess 8 by elastic holding means 10 for a radial and tangential hold. In an advantageous embodiment, elastic holding means 10 is divided into a first elastic holding means 13 and a second elastic holding means 14. This elastic holding means 10 takes the form of a dual system of springs and clips, formed here by a first elastic lip 13, which includes a bearing surface 11, arranged to act as a bottom stop member for insert 7, and by a second elastic lip 14, comprising a stop member 12, arranged to act as a top stop member for insert 7. The first elastic holding means 13 and second elastic holding means 14 are advantageously formed by elastic lips, which are preferably moveable in non-parallel directions to each other, and particularly in orthogonal directions to each other, and which exert stresses on insert 7 in opposite directions.

In this first variant embodiment of FIG. 1, insert 7 advantageously comprises at least one thread, not shown in the Figure, for receiving an adjusting screw for adjusting and poising the balance. This adjusting screw is moveable radially in the thread relative to balance staff 3.

In this second, tangential configuration, recess 8 and insert 7 are preferably arranged to ensure the insertion of insert 7 into recess 8 in a parallel direction to balance staff 3.

The second variant embodiment of FIG. 2 shows this arrangement. Insert 7 is axially driven or slid, via the top face or bottom face of felloe 5, into a cylindrical recess 8, which is partly formed by an elastic lip 13 also constituting the elastic holding means 10 forming a spring and holding insert 7 in place. This insert 7 has an unbalance relative to its pivot axis 17. This unbalance may be due, for example, to a hollow 15 made in the insert and remaining empty, thus allowing a tool to be inserted to perform an angular pivoting adjustment. However, it may also be due to the assembly of an added component, of higher density than that of insert 7, in a hollow 15 of this type or in a suitable recess.

In a preferred embodiment, elastic holding means 10 is arranged to hold insert 7 in recess 8 in an angular pivoting position relative to a pivot pin 17 of said insert 7 in recess 8. Preferably, this pivot axis 17 of the insert is parallel to balance staff 3. This is the case in the variants in FIGS. 2 to 6.

Figure 3:
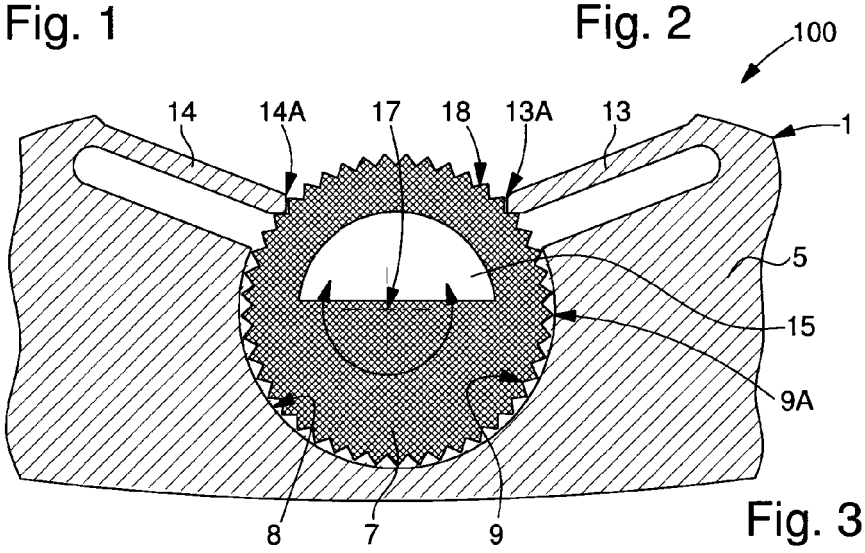
FIG. 3 shows, in a similar manner to FIG. 1, a third variant of the invention.

Advantageously, as seen in the third variant of FIG. 3, elastic holding means 10 is arranged, under the effect of a stress which tends to move said holding means away from the second, holding position, to pivot insert 7 inside recess 8 relative to pivot axis 17. This insert 7 is preferably of the type having an unbalance, similar to that of the second variant of FIG. 2, but it has a complementary guide means 9A made in the form of a toothing 18, which cooperates with guide means 9, formed here by a cylindrical bore, of recess 8.

In this third variant, first elastic holding means 13, or respectively second elastic holding means 14, which together form elastic holding means 10, advantageously acts as a retaining click when second elastic holding means 14, or respectively first elastic holding means 13, pivots insert 7. Here too, first elastic holding means 13 and second elastic holding means 14 are advantageously formed by elastic lips, whose directions are secant to each other, and whose ends 13A, 14*a* cooperate with toothing 18 carried at the periphery of insert 7. This third variant produces a double click setting adjustment in both pivoting directions around pivot axis 17 of insert 7. The first elastic holding means 13 and second elastic holding means 14, each formed by an elastic lip, exert torque in opposite directions on insert 7.

This arrangement of insert 7 with a peripheral toothing 18 can naturally be used in other variants, since it facilitates holding in a particular angular position.

In a fifth variant shown in FIGS. 5 and 8, insert 7 is made gripped and enclosed between at least two flanges 7A and 7B, which are arranged to rest on both sides of felloe 5 and to be assembled to each other by a means of permanent assembly, for example they are driven in, held by clips(?), bonded or similar, arranged like a rivet, or a nut and bolt, or similar, so that the sub-assembly formed by assembling these two flanges 7A and 7B has a maximum of one degree of freedom to pivot or move in translation relative to felloe 5. This embodiment prevents insert 7 from becoming detached from felloe 5 of balance 1. It is also possible to envisage making insert 7 in at least two complementary parts like these flanges 7A and 7B.

In a particular embodiment, which can be combined with the second, third, or fourth variants of FIGS. 2 to 4, all or part of the inserts 7 comprised in balance set 100 are made in the form of inserts 7 in two parts 7A and 7B as described above.

In order to reserve the possibility of subsequent fine adjustment, as seen in FIG. 5, insert 7 is preferably made so as to have, after insertion into balance 1, at least one visible surface, which is made in a material capable of being micromachined or undergoing laser material removal. Indeed, it must be possible to conveniently poise the balance by adjusting the unbalance, on the one hand, and to correct inertia on the other hand, and especially to very precisely adjust the oscillator frequency. The poising of a balance is an important operation, for which high poising precision is required, on the order of a microgramme per cm (?).

Advantageously, each insert 7 is given a particular shape, so as to allow, separately or at the same time:

- facilitated poising due to the existence of at least one flat surface, which is formed either by a flat "parallel surface" which is parallel to the balance plane 4, or by a flat "end surface" which is perpendicular to the balance plane 4 and to a radial line originating from balance staff 3. The same insert 7 may include both one or several parallel surfaces and one or several end surfaces;
- a reduced aerodynamic drag, insert 7 then including, in any section perpendicular to balance plane 4, and to a plane passing through balance staff 3, a radiating and/or sloping aerodynamic profile to reduce the friction thereof in the air. In order to limit aerodynamic drag, each insert 7 is preferably set back from a cylinder circumscribed to felloe 5, in any relative position of the parts which may form said insert, which may advantageously comprise added elements, such as adjusting screws or suchlike.

It is easy then to perform poising by milling or etching or other means on one of these surfaces, or by adding material, particularly by brazing, welding or plasma if the visible surface of insert 7 is metallic.

In a preferred embodiment, the joining surface 6 is formed of at least one arm 20. Owing to the use of silicon technology, this arm may adopt any profile, particularly a curved or other profile. It may also comprise lighter portions, which may or may not traverse the arm, for example in the form of triangular pockets, which provide rigidity yet allow a significant reduction in weight. FIG. 5 shows a version with an integer number of arms in diametrically opposite pairs.

FIG. 7 shows an example embodiment with an arm 20 comprising a mixed, pierced structure, which has, separated by ribs 30, pockets 29 through the entire thickness of joining surface 6, particularly of arm 20, and/or blind pockets 31, which only pass through part of the thickness of joining surface 6, and particularly of arm 20, for example a third of the surface, each separated by another similar blind pocket located on the other side of arm 20 by a web of comparable thickness.(?) The good triangulation achieved allows a substantial saving of mass. The lateral portions 30 which are essential for mechanical resistance and torsion resistance can be determined by a conventional calculation using finished elements (?). Of course, the annular portion of felloe 5 may also be pierced in a similar manner. The same is true if a continuous joining surface 6 is desired, such as a disc or similar.

For the purpose of lightening the balance further, felloe 5 may comprise one or more cut out portions 23 on the periphery thereof, or on the inner part of felloe 5.

Figure 9:
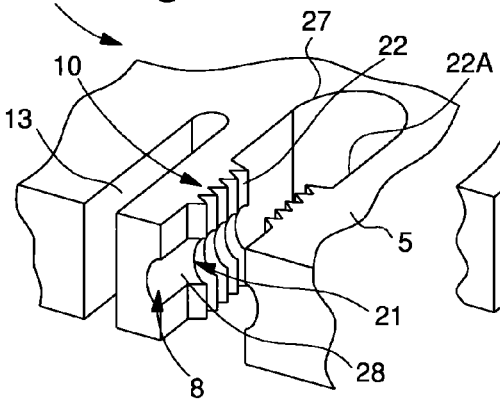
FIG. 9 shows a schematic, partial, perspective view of a sixth balance variant according to the invention.
Figure 10:
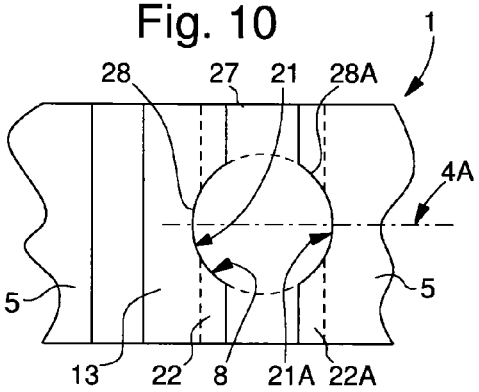
FIG. 10 shows a schematic, partial, end view of the sixth variant of FIG. 9.

The first, radial configuration of the invention, with radial insertion and adjustment of insert 7 relative to balance staff 3, is further illustrated by a sixth variant, shown in FIGS. 9 to 11, where insert 7 is formed by an adjusting screw 23, visible in FIG. 11. This adjusting screw 23 cooperates with threaded path sections 21 and 21A, located opposite each other, substantially in median plane 4A of balance 1. These threaded path sections 21 and 21A are obtained, in a balance 1 which is preferably made of silicon, by creating a taper (?), in a shape similar to that of a groove with a substantially circular profile, when the two straight toothings 22 and 22A facing each other are made. The "DRIE" process produces either sloped tapers, or tapers in this shape, which is preferred here, since, when combined with elastic holding means made in the form of at least one elastic lip 13, this shape enables adjusting screw 23 to be clamped. The thread 25 of said screw 23 cooperates in a conventional manner with the tapered toothing elements 28, respectively 28A produced when the circular taper is made, in a direction perpendicular to plane 4A, and which reproduce the straight toothing elements 21, respectively 21A (?). In short, these toothing elements 28 and 28A correctly reproduce a truncated thread. The choice of an adjusting screw 23 made of gold or similar, provided with an adjusting slot 24 or similar, allows precise adjustment. This adjusting screw 23 is screwed into its recess 8 by the suitable sizing of elastic lip 13, or lips if there are more than one, for example on both sides of recess 8.

Referring to the sixth variant, adjusting screw 23 may also be replaced by a splined shaft 40, which cooperates with notches or grooves 41 which then replace toothing elements 28, 28A.

Figure 12:
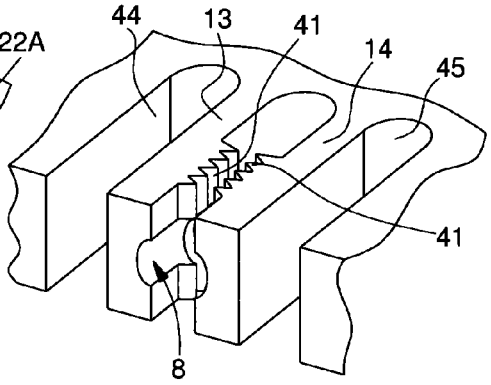
FIG. 12 shows a schematic, partial and perspective view of a seventh balance variant according to the invention.
Figure 13:
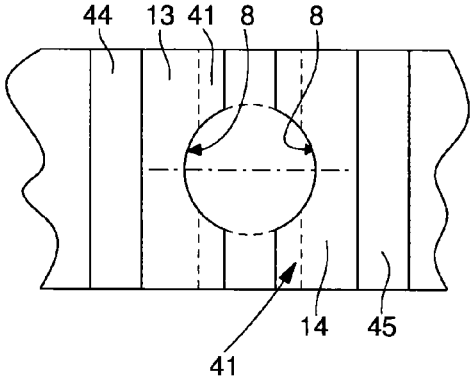
FIG. 13 shows a schematic, partial, end view of the seventh variant of FIG. 12.
Figure 14:
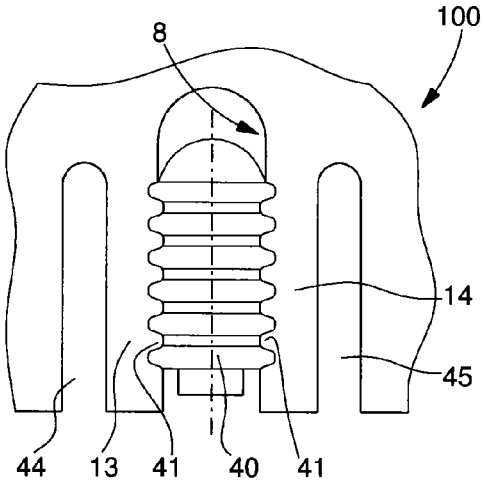
FIG. 14 shows a schematic, partial, front view of a balance set according to the seventh variant.

This configuration is illustrated in the context of a seventh advantageous variant, which is shown in FIGS. 12 to 14. This seventh variant includes at least one elastic lip 42, 43 on each side of insert 40. These elastic lips 42, 43 are arranged through slots 44, 45.

Naturally, this seventh variant may also adopt the configuration of the sixth variant with an adjusting screw cooperating with toothing elements on both sides, which are then respectively carried by the two elastic lips 42, 43.

It is to be noted that this splined or notched or knurled shaft 40 is not necessarily of revolution. They may, in particular, have a square section, or a section comprising faces in parallel pairs.

This solution of a splined or similar insert, arranged between notched walls, at least one of which is an elastic lip and preferably two notched or splined walls are elastic lips, is a particularly economical embodiment.

It is also possible to improve this sixth or seventh variant with a surface coating which forms a deformable layer allowing plastic deformation, with a low modulus of elasticity, lower than that of the basic material, particularly silicon and compounds thereof. Preferably, in combination with silicon or a compound thereof, the Young's modulus of this surface coating is chosen to be less than 8 GPa, and preferably less than 4 GPa. This deformable layer may, in particular, be formed of a gas-phase deposited polymeric layer.

This surface coating must be chosen for the good affinity it has with the basic material, particularly silicon and silicon compounds, and may also be used to directly form a recess 8 for an insert 7 or for an adjusting screw 23.

The invention further concerns a sprung balance incorporating at least one such balance 1, or at least one such balance set 100 according to any of the embodiments and any of the variants set out above.

The invention also concerns a timepiece incorporating at least one such sprung balance, or at least one such balance 1 or at least one such balance set 100.

The use of silicon allows considerably greater diameter dimensioning than could be achieved with a balance of conventional construction with similar inertia. The high level of elasticity of silicon is particularly advantageous for making the elastic holding means 10 of the invention.

The choice of silicon, in particular, allow elastic holding means 10 to be made in felloe 5, notably in the form of elastic lips 13 or 14. Likewise, stop means in the form of clicks may be combined with such strips or with springs made in the silicon felloe.

This choice of silicon or alloys obtained by the "LIGA" process, or generally derived from MEMS technology ensures a very precise geometry for felloe 5, because of excellent resolution during shaping, and thus prevents any play liable to produce vibrations and adversely affect the proper operation of the oscillator.

Moreover, the choice of silicon allows the insertion of etches and decorations in the balance and surface structuring to be carried out.

Preferably, each of the parts of each insert 7, and/or of each adjusting screw 23 is made of a material which is a heavy metal, or bronze or beryllium, or gold or platinum or tantalum or molybdenum, or an oxide or nitride thereof or an alloy thereof, or one of the complexes based thereon.

It is possible, owing to the invention, to achieve a measured quality factor of close to 500 for an oscillator incorporating a silicon balance spring and a balance or balance set according to the invention.

The combination between, on the one hand, this high quality factor, and on the other hand, the setting and adjustment possibilities offered by the inserts, which, in addition to their actual adjustment functions, perform a new function, which is to act as a machining platform for adding or removing material during poising adjustment and frequency setting operations, removes the requirement for an index-assembly.

The design of the balance allows very precise adjustment of the oscillation frequency of the sprung balance in which it is integrated. The setting and adjustment of the balance are very precise and enable the balance to be used in a high frequency oscillator at 10 Hz or higher.

The objects which the invention proposed to achieve are thus perfectly attained.

The invention claimed is:

1. A method of making a balance set for a timepiece, with inertia adjustment for adjusting inertia and/or balancing and/or oscillation frequency of the balance, including a balance including a hub configured to cooperate with a balance axis perpendicular to a balance plane, and a peripheral, continuous or discontinuous felloe, connected to said hub by at least one joining surface, said balance set including at least one insert, said balance further including, at a periphery of said felloe, at least one recess for receiving said at least one insert, said insert including a complementary guide means whose profile is complementary to a guide means included in said recess, said method comprising:

providing said balance and/or said insert with an elastic holding means arranged, in a first insertion position where said elastic holding means is stressed, to allow insertion of said insert into said recess and, in a second holding position in which said elastic holding means is released, to prevent removal of said insert from said recess;

inserting each said insert into a said recess by stressing the elastic holding means into said first insertion position;

releasing said elastic holding means into the second holding position after complete insertion of each said insert into said recess thereof, wherein said elastic holding means is configured to hold said insert in said recess in an angular pivoting position relative to a pivot axis of said insert in said recess, and wherein said elastic holding means is separated into a first elastic holding means and a second elastic holding means, said first elastic holding means, respectively said second elastic holding means, acting as a retaining click when said second elastic holding means, respectively said first elastic holding means pivots said insert.

2. The method according to claim 1, wherein said balance and said insert are provided with said elastic holding means.

3. The method according to claim 1, wherein said elastic holding means of said balance and said insert are made in said felloe of said balance, and wherein said felloe is made in a single piece with said joining surface and said hub in a micromachinable material, or silicon, or quartz or a compound thereof, or an alloy derived from MEMS technology, or an alloy obtained by LIGA process.

4. A balance set for a timepiece, with inertia adjustment for adjusting inertia and/or balancing and/or oscillation frequency of the balance, comprising:

a balance comprising at least one recess with a guide means;

at least one insert comprising a complementary guide means whose profile is complementary to said guide means;

said balance and/or said insert comprising an elastic holding means configured to allow insertion of said insert into said recess in a first insertion position where said elastic holding means is stressed, and to prevent removal of said insert from said recess in a second holding position where said elastic holding means is released;

said insert configured to be inserted into a said recess by the stressing of said elastic holding means into a first insertion position;

said elastic holding means configured to be released into said second holding position after the complete insertion of each said insert into each said recess thereof to hold said insert in said recess;

wherein said elastic holding means include at least a first elastic holding means and a second elastic holding means, formed by elastic lips and extending on both sides of said insert so as to exert stresses or torques in opposite directions on said insert.

5. The balance set according to claim 4, wherein said insert is gripped and enclosed between at least two flanges configured to rest on both sides of said felloe and to be assembled to each other by a permanent assembly so that the sub-assembly formed by assembling said two flanges has a maximum of one degree of freedom to pivot or move in translation relative to said felloe.

6. The balance set according to claim 4, wherein said insert is configured to have, after insertion into said balance, at least one visible surface made of a material capable of being micromachined or undergoing laser material removal.

7. The balance set according to claim 4, wherein said elastic holding means is configured to hold said insert in said recess in an angular pivoting position relative to a pivot axis of said insert in said recess, and wherein said complementary guide means of said insert is made in a form of a toothing at a periphery of said insert which cooperates with ends of said elastic lips whose directions are secant to each other.

8. The balance set according to claim 7, wherein said first elastic holding means, respectively said second elastic holding means, acts as a retaining click when said second elastic holding means, respectively said first elastic holding means pivots said insert, so as to perform a double ratchet setting adjustment in both pivoting directions about a pivot axis of said insert.

9. The balance set according to claim 4, wherein said elastic holding means is configured, under effect of a stress tending to move said elastic means away from said second holding position, to pivot said insert inside said recess relative to a pivot axis of said insert in said recess.

10. The balance set according to claim 4, wherein said insert is formed by an adjusting screw moveable between threaded path sections which are located opposite each other.

11. The balance set according to claim 10, wherein said threaded path sections each comprise a taper, in a form of a groove with a substantially circular section formed when two straight toothings facing each other are made.

12. The balance set according to claim 11, wherein said taper, combined with an elastic holding means in a form of at least one elastic lip, clamps said adjusting screw, a thread of which cooperates with toothing elements with a tapered profile which are produced when said taper is made and which reproduce a truncated thread.

13. The balance set according to claim 4, wherein said elastic holding means is made in said felloe of said balance and is configured to hold said insert in said recess in a radial direction relative to said balance axis for a radial adjustment of said insert.

14. The balance set according to claim 4, wherein said guide means and said complementary guide means are configured, in said second holding position, to allow said insert mobility in translation and/or by pivoting inside said recess.

15. The balance set according to claim 4, wherein said elastic holding means is made in said felloe of said balance and configured to hold said insert inside said recess in a radial direction relative to said balance axis, said elastic holding means then forming an active thrust means by forming a bearing surface which tends to push said insert against at least one fixed orelastic stop member provided in said recess.

16. A sprung balance incorporating at least one balance set according to claim 4, wherein said felloe is in a single piece with said joining surface and said hub in a micro-machinable material, or silicon, or quartz, or a compound thereof, or an alloy derived from MEMS technology or an alloy obtained by LIGA process.

17. A timepiece incorporating at least one sprung balance according to claim 16, wherein said felloe is made in a single piece with said joining surface and said hub of a micro-machinable material, or silicon, or quartz, or a compound thereof, or an alloy derived from MEMS technology, or an alloy obtained from LIGA process.

* * * * *